United States Patent [19]

Johne et al.

[11] 4,385,560

[45] May 31, 1983

[54] REMOTE ADJUSTMENT AND MEASURING UNIT FOR INK ZONING SCREW OF A DOCTOR BLADE MECHANISM IN AN INK FOUNTAIN OF A PRINTING MACHINE

[75] Inventors: Hans Johne, Radebeul; Arndt Jentzsch; Wolfgang Müller, both of Coswig; Karl-Heinz Förster, Dresden; Helmut Schuck, Coswig, all of German Democratic Rep.

[73] Assignee: Veb Kombinat Polygraph "Werner Lamberz" Leipzig, Leipzig, German Democratic Rep.

[21] Appl. No.: 251,317

[22] Filed: Apr. 6, 1981

[30] Foreign Application Priority Data

Apr. 10, 1980 [DD] German Democratic Rep. ... 220337

[51] Int. Cl.[3] ..... B41F 3/04

[52] U.S. Cl. ..... 101/365

[58] Field of Search ..... 101/364, 365, 148, 350–351, 101/363, 169, 325, 326, 311, 319, 203 R

[56] References Cited

U.S. PATENT DOCUMENTS 3,747,524 7/1973 Crum ..... 101/365

FOREIGN PATENT DOCUMENTS 2007594 5/1979 United Kingdom ..... 101/365

*Primary Examiner*—E. H. Eickholt

*Attorney, Agent, or Firm*—Michael J. Striker

[57] ABSTRACT

A remote adjustment and measuring unit for an ink zoning screw of a doctor blade mechanism in an ink well of a printing machine comprises a housing in which is adjustably mounted a guiding bearing for the rear end portion of the zoning screw; a driving electric motor and a measuring potentiometer are provided respectively with pinions in mesh with a transmission gear on the rear end portion of the screw, and the motor and the potentiometer are each mounted on an adjustable supporting plate.

5 Claims, 1 Drawing Figure

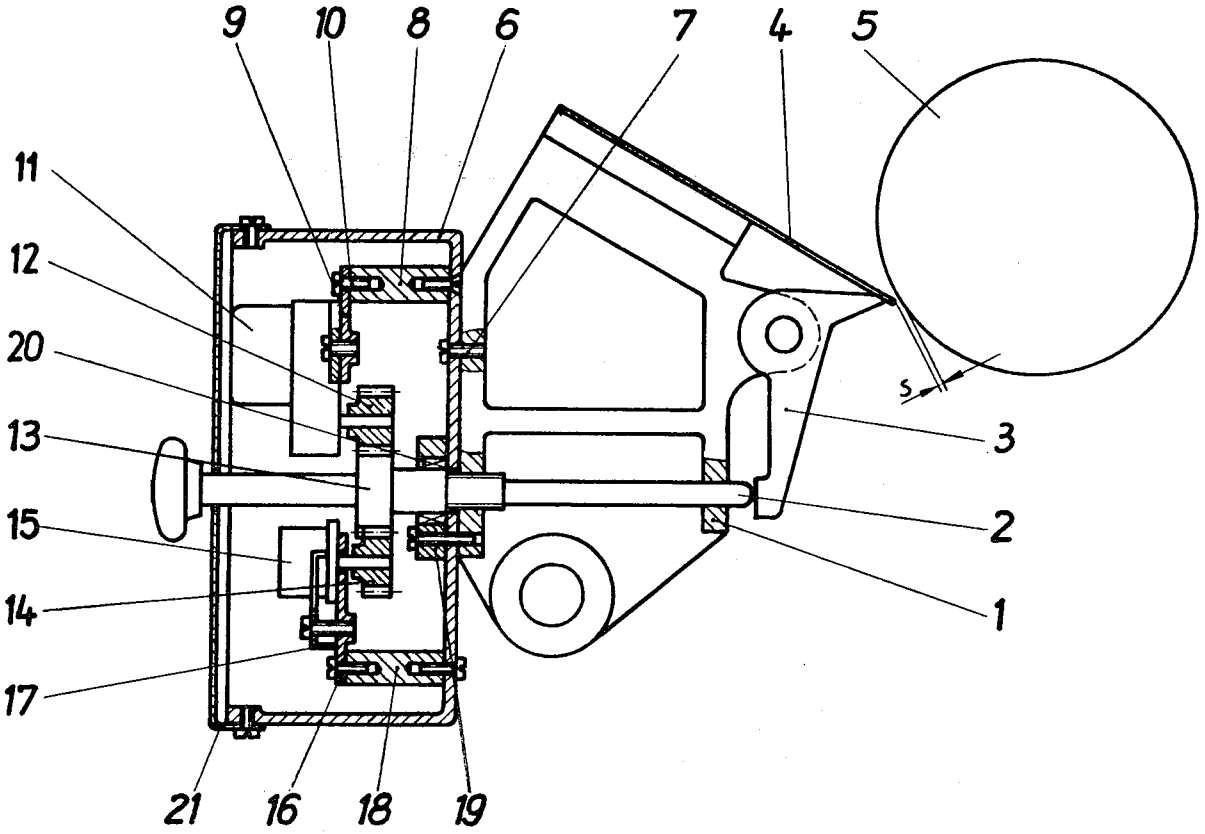
5
4
7
6
8
10
9
11
12
20
13
15
14
17
21
16
18
19
1
2
3
s

REMOTE ADJUSTMENT AND MEASURING UNIT FOR INK ZONING SCREW OF A DOCTOR BLADE MECHANISM IN AN INK FOUNTAIN OF A PRINTING MACHINE

BACKGROUND OF THE INVENTION

The present invention relates in general to printing machines and in particular to a remote adjustment and measuring unit for ink zoning in ink fountains of the printing machines, the unit being of the type having a motor-transmission gear subunit and a measuring potentiometer.

From the DL patent 139 114 an arrangement for remote ink zoning is known in which an adjustment screw engages a threaded hole in the ink fountain and is supported for rotation in an adjustable holder. The adjustment screw is connected via a spur gear to a driving pinion of an electric motor so that a remote control of the rotation of the zoning screw is made possible.

The disadvantage of this prior-art arrangement is the fact that the guiding of the screw is insufficient for reliably setting the torque from the motor and consequently unintentional locking of the screw frequently occurs. Another disadvantage of this known solution is the fact that no provision is made for measuring and indicating the adjusted position of the screw.

SUMMARY OF THE INVENTION

It is therefore a general object of the present invention to overcome the aforementioned disadvantages.

More particularly, it is an object of the invention to provide an improved adjustment and measuring unit of the above-described type which ensures a trouble-free operation and a repeatable adjustment of the doctor blade in the ink fountain.

Another object of this invention is to provide such an improved adjustment and measuring unit which is reliable in operation and permits an accurate matching of the setting screw to the employed driving and measuring subunit.

In keeping with these objects, and others which will become apparent hereafter, one feature of the invention resides, in an adjustment and measuring unit for an ink zoning screw of a doctor blade mechanism in an ink fountain, in a combination which comprises a bearing arranged between a transmission gear mounted on the zoning screw and the threaded hole in the wall of the ink fountain, for supporting the rear end of the zoning screw, and a potentiometer having a shaft provided with a pinion engaging the transmission gear on the screw.

In the preferred embodiment, the bearing is mounted in a holder which is adjustable relative to the zoning screw and the bearing has preferably the form of a needle bearing. Similarly, the electric motor is provided with a driving pinion engaging the transmission gear on the rear end of the zoning screw and the engagement can be adjusted by changing the position of the mounting plate for the motor. Similarly, the measuring potentiometer is supported on an adjustable mounting plate so that the engagement of the driven gear or pinion on its shaft can be finely matched to the transmission gear and for adjusting the zero position of the potentiometer shaft with respect to the zero positin of the zoning screw, the potentiometer housing is freely rotatable on the mounting plate and is fixed in the zero position by means of a clamping angle.

By virtue of the above-described measures, a play-free transmission of movements from the motor to the zoning screw can be readily adjusted and consequently an exact and reproducible setting of the gap between the doctor blade and a doctor roller is always obtainable. The instant position of each ink zoning screw is read by the corresponding potentiometer and made readable by a remote indicator.

The resulting ink zoning unit is simple in structure and in the event of a failure of a component part the latter is easy to exchange and be readjusted with minimum expenditures.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is a sectional side view of an ink fountain provided with an adjustment and measuring unit of this invention.

DESCRIPTION OF THE PREFERRED EMBODIMENT

An ink fountain 1 is provided with a threaded hole engaging a threaded portion of an ink zoning screw 2. The front end of the screw 2 abuts against an arm of an adjustment lever 3 the other arm of which controls the position of a doctor blade 4 with respect to a doctor roller 5. The adjustable clearance between the edge of the doctor blade 4 and the circumference of the doctor roller is the inking gap S. In the ink fountain 1, there are arranged several ink zoning screws 2 with corresponding adjustment units. The adjustment units are arranged in housing 6 secured by means of screws 7 to the outer wall of the ink fountain 1.

Within the housing 6, there are assigned to each zoning screw 2 spacer bolts 8 and 18. Spacer bolt 8 supports a mounting plate 9 for an electric motor 11. The position of the mounting plate 9 is adjustable and fixed by a screw 10. The shaft of motor 11 is provided with a driving pinion 12 meshing with a spur gear 13 rigidly connected to the rear end portion of the screw 2. The electric motor 11, driving pinion 12 and spur gear 13 form together a driving and transmission gear subunit.

In addition, the spur gear 13 meshes with a pinion 14 rigidly connected to the shaft of a measuring potentiometer 15 serving for indicating the angular and axial position of the zoning screw 2. Potentiometer 15 is freely supported on a plate 16 and is fixed thereto by means of a clamping angle 17. The plate 16, similarly as the mounting plate 9 for the motor, is adjustably mounted on the spacer 18 and secured in position by a fastening screw.

In order to ensure a reliable guiding support for the rotary screw 2, the section of the screw between the transmission gear 13 and the threaded part of the screw is supported for rotation and for an axial displacement in a bearing 20 resting on a bearing support 19. The bearing support is adjustably secured to the inner wall of housing 6 by suitable fastening elements such as screws. The bearing 20 is with advantage a needle bearing and due to the positional adjustability of its mount 19 it is always possible to ensure an exact and axial alignment of the bearing 20 with respect to the threaded hole for the screw 2 in fountain 1.

The electric motor 11 controlled from a non-illustrated control station to rotate via transmission gears 12 and 13 the screw 2, is also position-adjustable by means of the aforementioned adjustable mounting plate 9 and the fixing screw 10 so that the axial alignment of driving pinion 12 with the axis of screw 2 and of the spur gear 13 can be very accurately set. Consequently, any locking action between the teeth of the transmission gears is eliminated.

The starting or zero point position of the potentiometer 15 is adjusted with respect to the corresponding starting position of zoning screw 2 upon loosening the clamping angle 17 and retightening the same to the plate 16. The axial alignment of the driven pinion 14 on the shaft of potentiometer 15 with the spur gear 13 is carried out in the same manner as in the case of pinion 12, by adjusting the mutual position of the supporting plate 16 with respect to the spacer 18.

Housing 6 of the adjustment and measuring unit is closed by a cover plate 21. The removable cover plate facilitates a convenient access to all component parts of the adjustment and measuring unit of this invention.

It will be understood that each of the elements described above, or two or more together, may also find a useful application in other types of constructions differing from the types described above.

While the invention has been illustrated and described as embodied in a specific example of the adjustment and measuring unit, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of this invention.

What is claimed as new and desired to be protected by Letters Patent is set forth in the appended claims:

1. A remote adjustment and measuring unit for an ink zoning screw of a doctor blade mechanism in an ink fountain of a printing machine, the screw engaging a threaded hole in the ink fountain and having a projecting rear end portion, said unit comprising a housing connectable to said ink fountain in the range of said threaded hole, a bearing mounted on said housing for supporting and guiding the rear end portion of the screw, a driving electric motor mounted in said housing, transmission gears interconnecting said motor and said rear end portion of the screw, a measuring potentiometer mounted in said housing and having its shaft provided with an additional gear in mesh with one of said transmission gears, and said bearing for the rear end portion of the screw being located between said transmission gears and said threaded hole.

2. A remote adjustment and measuring unit as defined in claim 1, wherein said bearing is mounted in a holder which is adjustably secured to said housing to permit an accurate centering of said bearing with respect to said threaded hole.

3. A remote adjustment and measuring unit as defined in claim 1, wherein said bearing is a needle bearing.

4. A remote adjustment and measuring unit as defined in claim 1, wherein said electric motor is supported on an adjustable mounting plate secured in position relative to said housing to permit an accurate axial adjustment of the shaft of said motor and of the axis of said transmission gears with respect to said screw.

5. A remote adjustment and measuring unit as defined in claim 1, wherein said potentiometer is supported on an adjustable mounting plate releasably connected to said housing and being secured to said mounting plate by a releasable clamping angle to permit the angular adjustment of the starting position of the potentiometer relative to the starting position of the screw.

* * * * *